US009880515B2

(12) United States Patent
Nohara

(10) Patent No.: US 9,880,515 B2
(45) Date of Patent: Jan. 30, 2018

(54) IMAGE FORMING APPARATUS

(71) Applicant: KYOCERA Document Solutions Inc., Osaka-shi, Osaka (JP)

(72) Inventor: Yuta Nohara, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/465,368

(22) Filed: Mar. 21, 2017

(65) Prior Publication Data

US 2017/0285563 A1 Oct. 5, 2017

(30) Foreign Application Priority Data

Mar. 29, 2016 (JP) ..... 2016-065672

(51) Int. Cl.
*G03G 21/16* (2006.01)
*G03G 15/08* (2006.01)

(52) U.S. Cl.
CPC ..... *G03G 21/1647* (2013.01); *G03G 15/0865* (2013.01)

(58) Field of Classification Search
CPC ..... G03G 15/0834; G03G 21/1864; G03G 21/1871
See application file for complete search history.

(56) References Cited

U.S. PATENT DOCUMENTS 5,508,795 A * 4/1996 Kikuchi ..... G03G 21/1814 399/262
5,893,007 A * 4/1999 Lim ..... G03G 15/0856 399/13

FOREIGN PATENT DOCUMENTS

JP 2006078586 A 3/2006

* cited by examiner

*Primary Examiner* — Victor Verbitsky
(74) *Attorney, Agent, or Firm* — Alleman Hall Creasman & Tuttle LLP

(57) ABSTRACT

In a case where a developer bottle is not attached to a bottle attachment portion, a movable support portion is kept to be at a support position, by an elastic force of a second spring, at which to support the bottle attachment portion to be higher than a reference level in position. In a case where the developer bottle is attached to the bottle attachment portion, a movable arm portion extending from the movable support portion toward an attachment space contacts the developer bottle and is displaced to outside the attachment space, which causes the movable support portion to be displaced from the support position to a release position at which to release a support of the bottle attachment portion. A control portion prohibits an image forming process when the position of the bottle attachment portion is not equal to or lower than the reference level.

6 Claims, 5 Drawing Sheets

IMAGE FORMING APPARATUS

INCORPORATION BY REFERENCE

This application is based upon and claims the benefit of priority from the corresponding Japanese Patent Application No. 2016-065672 filed on Mar. 29, 2016, the entire contents of which are incorporated herein by reference.

BACKGROUND

The present disclosure relates to an electrophotographic image forming apparatus.

A typical electrophotographic image forming apparatus has a bottle attachment portion to which a developer bottle is attached in a detachable manner so that waste developer collected from an image forming portion can be stored in the developer bottle. The waste developer refers to used developer that is collected from the image forming portion.

It is noted that the developer bottle is used as a bottle in which unused developer to be supplied to a developing portion, may be recycled as a bottle for storing the waste developer afterwards.

The image forming apparatus has a function to detect and notify that the developer bottle is full of waste developer. The user recognizes from the notification that the developer bottle should be replaced.

It is known, for example, that the image forming apparatus may include a spring and a detection sensor, the spring supporting the load of the bottle attachment portion and the developer bottle attached thereto, the detection sensor detecting that the bottle attachment portion has dropped to a predetermined height. In this case, based on the detection result of the detection sensor, the image forming apparatus can notify that the developer bottle is full of waste developer.

SUMMARY

An image forming apparatus according to an aspect of the present disclosure executes an image forming process for forming an image on a sheet, and includes a bottle attachment portion, a first elastic member, a level detection portion, a movable support portion, a movable arm portion, a second elastic member, and a control portion. The bottle attachment portion is supported in such a way as to be capable of being lifted and lowered and to which a developer bottle for storing developer is attached in a detachable manner. The first elastic member applies an upward elastic force to the bottle attachment portion. The level detection portion detects whether or not a position of the bottle attachment portion in an up-down direction is equal to or lower than a predetermined reference level. The movable support portion is supported in such a way as to be capable of being displaced from a support position at which to support the bottle attachment portion to be higher than the reference level in position. The movable arm portion extends from the movable support portion toward an attachment space which is formed in the bottle attachment portion to store the developer bottle therein. The second elastic member applies an elastic force to the movable support portion or the movable arm portion in a direction in which the movable support portion moves toward the support position. The control portion prohibits the image forming process when the level detection portion detects that the position of the bottle attachment portion is not equal to or lower than the reference level. In a case where the developer bottle is not attached to the bottle attachment portion, the movable support portion is kept to be at the support position by the elastic force of the second spring, and the movable arm portion is kept to be projected into the attachment space. In a case where the developer bottle is attached to the bottle attachment portion, the movable arm portion contacts the developer bottle and is displaced to outside the attachment space, which causes the movable support portion to be displaced from the support position to a release position at which to release a support of the bottle attachment portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
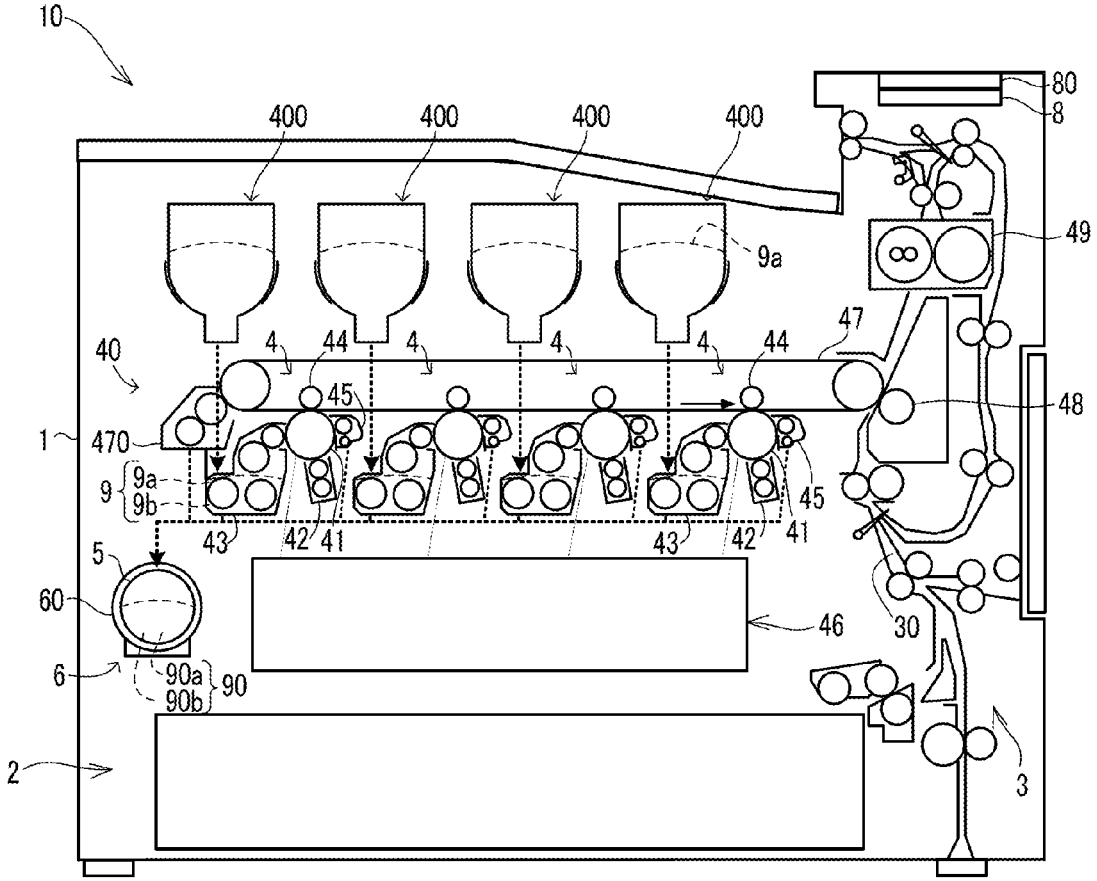
FIG. 1 is a configuration diagram of an image forming apparatus according to an embodiment of the present disclosure.

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

An image forming apparatus 10 according to an embodiment of the present disclosure is configured to form an image on a sheet by an electrophotographic system. The sheet is a sheet-like image formation medium such as a sheet of paper or an envelope.

The image forming apparatus 10 includes, in a main body portion 1, a sheet supply portion 2, a sheet conveying portion 3, an image forming portion 40, a laser scanning portion 46, a fixing portion 49, toner replenishing portions 400, and a waste developer collecting portion 6.

The image forming portion 40 executes an image forming process of forming an image on a sheet by using developer 9. The image forming portion 40 includes image forming units 4 and other equipment related to developing and conveyance of the developer 9. The developer 9 is two-component developer composed of toner 9*a* and carrier 9*b*. The carrier 9*b* is a granular material having magnetism.

The image forming apparatus 10 shown in FIG. 1 is a tandem-type image forming apparatus and is a color printer. As a result, the image forming portion 40 includes a plurality of image forming units 4 corresponding to a plurality of colors of the toner 9*a*, an intermediate transfer belt 47, a secondary transfer device 48, and a secondary cleaning portion 470. In addition, a plurality of toner replenishing portions 400 are provided respectively in correspondence with the colors of the toner 9*a*.

Each of the image forming units 4 includes a photoconductor 41, a charging portion 42, a developing portion 43, a primary transfer portion 44, and a primary cleaning portion 45.

The sheet supply portion 2 feeds the sheet to a sheet conveyance path 30, and the sheet conveying portion 3 conveys the sheet along the sheet conveyance path 30. The intermediate transfer belt 47 is an endless belt-like member and rotates in a state of being suspended between two rollers.

In each of the image forming units 4, the drum-like photoconductor 41 rotates and the charging portion 42 uniformly charges the surface of the photoconductor 41. The laser scanning portion 46 writes an electrostatic latent image on the charged surface of the photoconductor 41 by scanning a laser beam thereon.

The developing portion 43 develops the electrostatic latent image as an image of the toner 9*a*, by using the developer 9 that is composed of the carrier 9*b* and the toner 9*a*, wherein the carrier 9*b* is held in the developing portion 43 in advance, and fresh toner 9*a* is supplied from the toner replenishing portion 400. This allows an image of the toner 9*a* to be formed on the surface of the photoconductor 41.

The primary transfer portion 44 transfers the image of the toner 9*a* from the surface of the photoconductor 41 to the intermediate transfer belt 47. As a result, images of the plurality of colors of toner 9*a* are transferred from the plurality of photoconductors 41 to the intermediate transfer belt 47. This allows the images of the plurality of colors of toner 9*a* to be overlaid with each other and a color image is formed on the intermediate transfer belt 47. The primary cleaning portion 45 removes the toner 9*a* that has remained on the surface of the photoconductor 41.

It is noted that the photoconductor 41 and the intermediate transfer belt 47 are an example of the image carrying member that carries the image of the toner 9*a*.

The secondary transfer portion 48 transfers the color image formed on the intermediate transfer belt 47 to the sheet. The secondary cleaning portion 470 removes the toner 9*a* that has remained on the intermediate transfer belt 47. The fixing portion 49 fixes the color image to the sheet by heating.

The toner 9*a* that has been removed from the photoconductors 41 and the intermediate transfer belt 47 by the primary cleaning portions 45 and the secondary cleaning portion 470 is conveyed to the waste developer collecting portion 6 and collected in a developer bottle 5 of the waste developer collecting portion 6. The developer bottle 5 is attached to a bottle attachment portion 60 of the waste developer collecting portion 6 in a detachable manner.

Furthermore, the toner 9*a* that is flying in the developing portion 43 and a part of the carrier 9*b* that has been deteriorated in the developing portion 43 are conveyed to the waste developer collecting portion 6 and collected in the developer bottle 5.

In the following description, used developer 9 that is collected in the developer bottle 5 from the primary cleaning portion 45, the secondary cleaning portion 470 and the developing portion 43 is referred to as waste developer 90.

The waste developer 90 includes waste toner 90*a* and waste carrier 90*b*, wherein the waste toner 90*a* is toner 9*a* collected from the primary cleaning portion 45, the secondary cleaning portion 470 and the developing portion 43, and the waste carrier 90*b* is carrier 9*b* that is collected in the developer bottle 5 from the developing portion 43.

It is noted that in the present embodiment, the plurality of image forming units 4, the intermediate transfer belt 47, the secondary transfer device 48, and the secondary cleaning portion 470 constitute part of the image forming portion 40. In the image forming apparatus 10, the waste developer 90 collected from the image forming portion 40 is stored in the developer bottle 5.

Furthermore, the image forming apparatus 10 includes a control portion 8 and a display portion 80. The control portion 8 performs various calculations and control of electric devices included in the image processing apparatus 10. The display portion 80 displays information output from the control portion 8.

[Waste Developer Collecting Portion 6]

Figure 2:
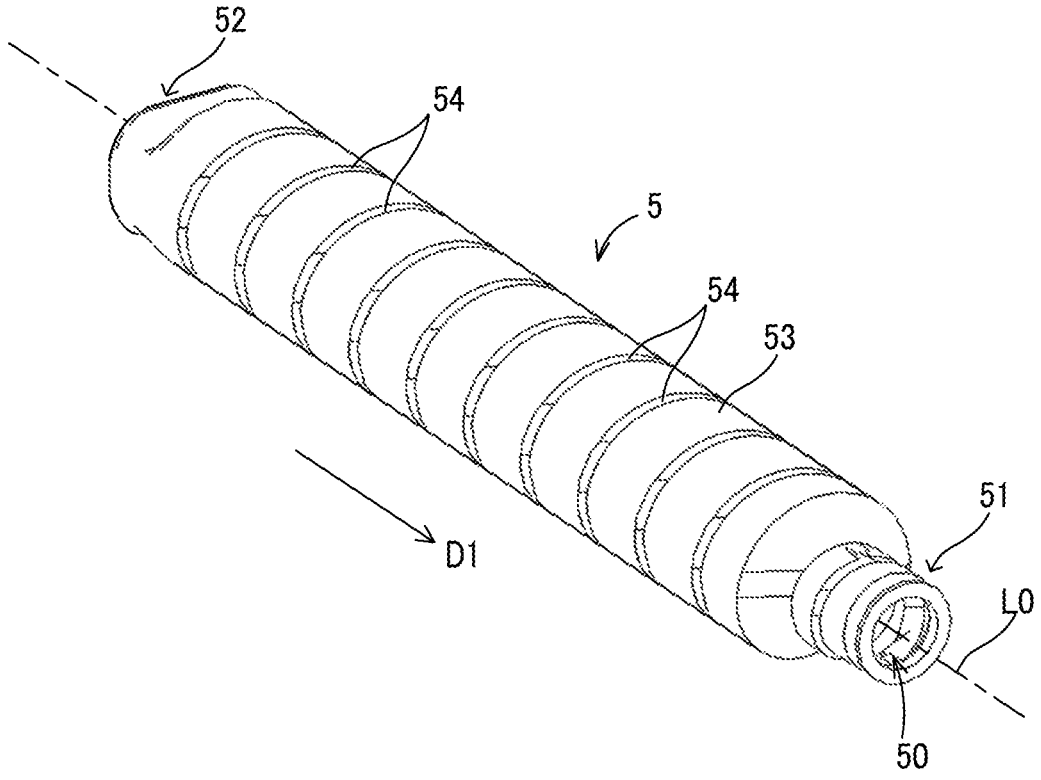
FIG. 2 is a perspective view of a developer bottle included in the image forming apparatus according to the embodiment.

As shown in FIG. 2, the developer bottle 5 is an elongated hollow member and has two opposite ends, a first end 51 and a second end 52, in a longitudinal direction thereof. An opening 50 from which the waste developer 90 is stored in the developer bottle 5, is formed in the first end 51.

The developer bottle 5 is attached to the bottle attachment portion 60 in a state where its longitudinal direction is parallel to the horizontal direction. In the following description, a direction in which the developer bottle 5 is inserted in the bottle attachment portion 60 with the opening 50 first, is referred to as a bottle insertion direction D1.

Figure 4:
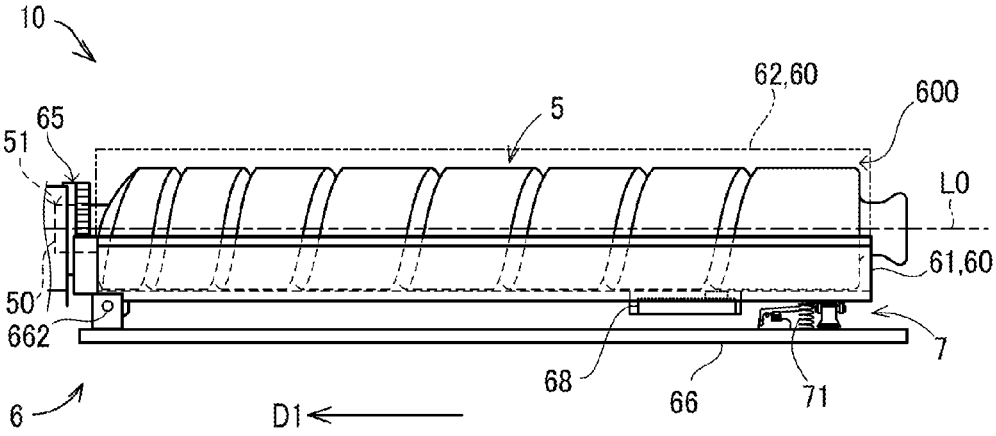
FIG. 4 is a configuration diagram of the waste developer collecting portion of the image forming apparatus according to the embodiment.
Figure 5:
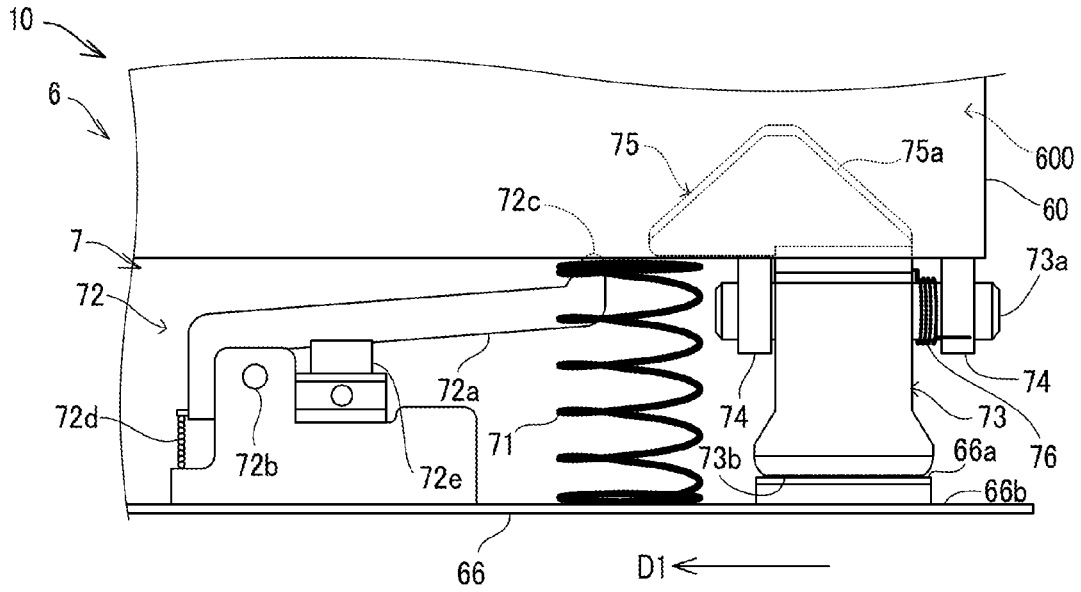
FIG. 5 is a side view of a bottle detection portion in the waste developer collecting portion of the image forming apparatus according to the embodiment.
Figure 6:
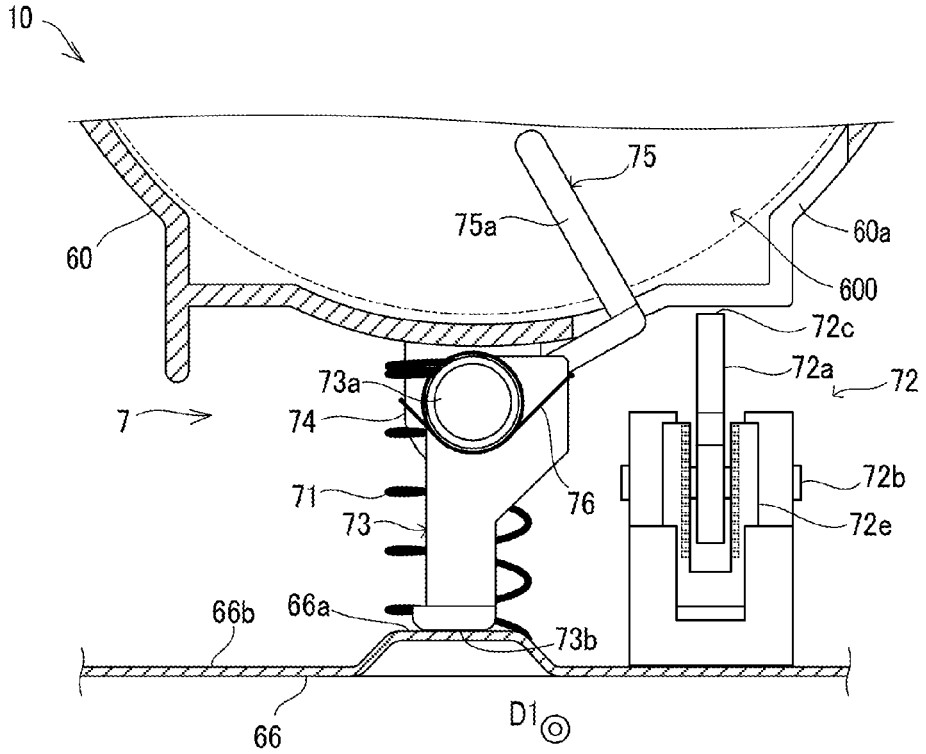
FIG. 6 is a front view of the bottle detection portion in a locked state in the waste developer collecting portion of the image forming apparatus according to the embodiment.
Figure 7:
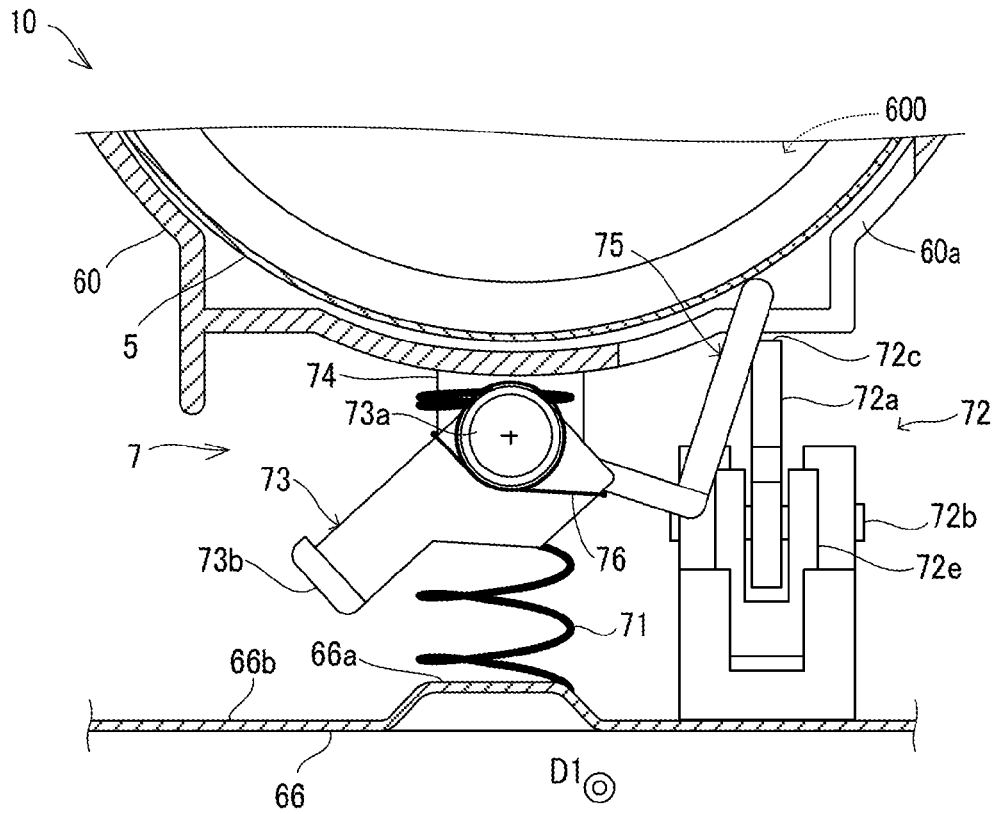
FIG. 7 is a front view of the bottle detection portion in an unlocked state in the waste developer collecting portion of the image forming apparatus according to the embodiment.

In FIG. 4 and FIG. 5, a leftward direction is the bottle insertion direction D1, and in FIG. 6 and FIG. 7, a direction toward the plane of figure is the bottle insertion direction D1.

The developer bottle 5 includes a spiral projection portion 54 that is formed in a spiral shape around a center line L0 that is parallel to the longitudinal direction of the developer bottle 5. The spiral projection portion 54 projects toward the inside of the developer bottle 5. It is noted that when viewed from outside of the developer bottle 5, the spiral projection portion 54 is a spiral recess portion.

Figure 3:
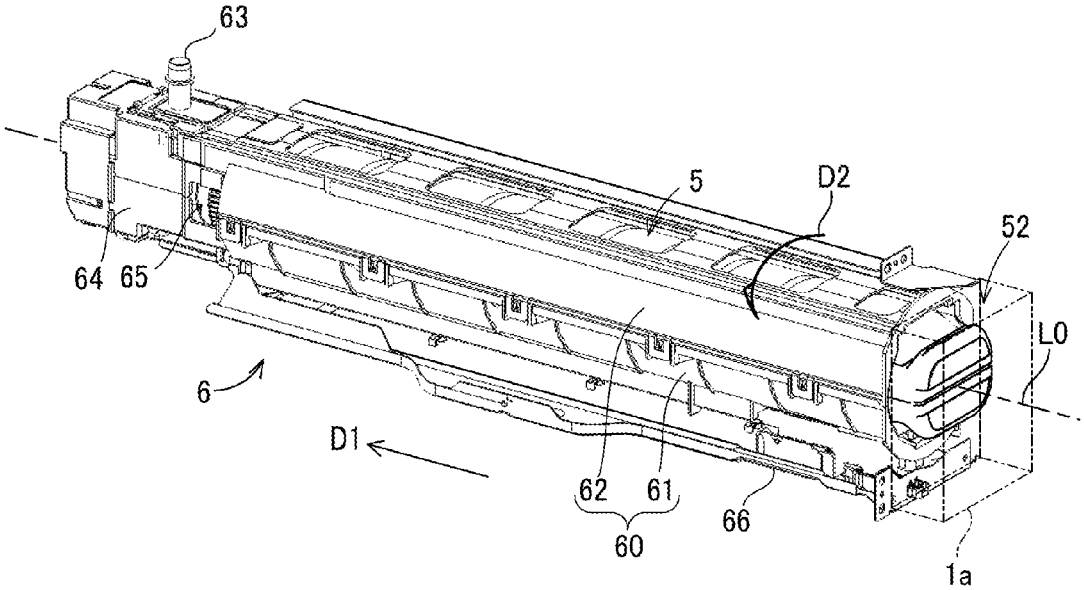
FIG. 3 is a perspective view of a waste developer collecting portion of the image forming apparatus according to the embodiment.

As shown in FIG. 3 and FIG. 4, the waste developer collecting portion 6 includes the bottle attachment portion 60, a reception duct 63, a conveyance relay portion 64, a drive transmission portion 65, and a support frame 66. The bottle attachment portion 60 includes a bottle reception portion 61 and a bottle cover 62 assembled together.

For example, the bottle reception portion 61 may be made of metal, and the bottle cover 62 may be made of synthetic resin. It is noted that in FIG. 4, the bottle cover 62 is represented by an imaginary line (a two-dot chain line).

The bottle reception portion 61 supports an outer circumferential surface 53 of the developer bottle 5 from below, and the bottle cover 62 covers the developer bottle 5 from above. The bottle attachment portion 60 has, in its inside, an attachment space 600 in which the developer bottle 5 is inserted along the longitudinal direction. The attachment space 600 is a space in which the developer bottle 5 is attached.

The developer bottle 5 is attached to the bottle attachment portion 60 by being inserted from an entrance of the bottle attachment portion 60 along the bottle insertion direction D1 with the opening 50 first. In addition, the developer bottle 5 is removed from the bottle attachment portion 60 by being pulled out from the attachment space 600 in a direction opposite to the bottle insertion direction D1.

A part of the exterior of the main body portion 1 forms an opening/closing cover 1*a* that is opened when the developer bottle 5 is attached or removed. In FIG. 3, the opening/closing cover 1*a* is represented by an imaginary line.

The reception duct 63 receives the waste developer 90 that has been dropped from a waste developer conveyance mechanism (not shown). The reception duct 63 is formed to extend along the vertical direction. The waste developer conveyance mechanism conveys the waste developer 90 from the primary cleaning portion 45, the secondary cleaning portion 470 and the developing portion 43 to above the reception duct 63.

The conveyance relay portion 64 has a relay conveyance path (not shown) in its inside. The relay conveyance path is a conveyance path of the waste developer 90 connecting the reception duct 63 and the opening 50 of the developer bottle 5. The waste developer 90 is conveyed through the reception duct 63, the relay conveyance path in the conveyance relay portion 64, and the opening 50 into the developer bottle 5.

The drive transmission portion 65 is a gear mechanism that transmits the rotational force of a motor (not shown) to the developer bottle 5. The developer bottle 5 attached to the bottle attachment portion 60 receives power from the drive transmission portion 65 and rotates in a predefined rotation direction D2 around the center line L0.

The rotation of the developer bottle 5 in the predefined rotation direction D2 prevents the waste developer 90 from stagnating at the opening 50 in the developer bottle 5 that is laid horizontally. Furthermore, the rotation reduces the deviation of distribution of the waste toner 90*a* and the waste carrier 90*b* in the developer bottle 5.

The bottle attachment portion 60 is rotatably supported by the support frame 66 that constitutes a part of the main body portion 1. A support shaft 662 that pivotably supports the bottle attachment portion 60, is provided at a position close to the first end 51 of the attached developer bottle 5.

That is, the bottle attachment portion 60 is supported by the support frame 66 in such a way as to be capable of being lifted and lowered around the support shaft 662. The support frame 66 may be made from, for example, a metal plate.

Furthermore, in the waste developer collecting portion 6, a spring 71 applies an upward elastic force to the bottle attachment portion 60. The spring 71 applies the elastic force to the bottle attachment portion 60, at a position close to the second end 52 of the developer bottle 5 attached to the bottle attachment portion 60. It is noted that the spring 71 is included in a bottle detection portion 7 that is described below.

As the waste developer 90 in the developer bottle 5 increases in weight, the bottle attachment portion 60 is displaced downward around the support shaft 662.

Meanwhile, in a case where the developer bottle 5 is not attached to the bottle attachment portion 60, it is necessary to prohibit the image forming portion 40 from performing the image forming process. As a result, for example, in a case where a predetermined position sensor does not detect the bottle attachment portion 60 within a range whose upper limit is a predetermined reference height, the control portion 8 may prohibit the image forming process, and otherwise, the control portion 8 may release the prohibition of the image forming process.

However, in the image forming apparatus 10, parts like the bottle attachment portion 60 may have variation in size, parts like the developer bottle 5 may have variation in weight, and parts like the spring 71 that support the load of the bottle attachment portion 60 may have variation in characteristics. Due to such variations, there may be a case where the bottle attachment portion 60 is detected within the range whose upper limit is the reference height although the developer bottle 5 is not attached to the bottle attachment portion 60, or a case contrary to that.

The bottle detection portion 7 is configured to be prevented from detecting erroneously whether or not the developer bottle 5 is attached to the bottle attachment portion 60 due to variations in size, weight, and characteristics of the parts. The following describes the bottle detection portion 7.

[Bottle Detection Portion 7]

As shown in FIG. 4, the bottle detection portion 7 is provided at a position close to the entrance of the bottle attachment portion 60 from which the developer bottle 5 is inserted.

The bottle detection portion 7 includes the spring 71, a position detection portion 72, a movable support portion 73, a movable arm portion 75, and a spring 76. In the following description, among the springs that act on the bottle attachment portion 60, the spring 71 is referred to as a first spring 71, and the spring 76 is referred to as a second spring 76.

As described above, the first spring 71 applies an upward elastic force to the bottle attachment portion 60. In the example shown in FIG. 5 to FIG. 7, a compression coil spring is used as the first spring 71. However, the first spring 71 may be rubber or another type of spring such as a tension coil spring that can lift the bottle attachment portion 60. It is noted that the first spring 71 is an example of the first elastic member.

The position detection portion 72 detects a position of the bottle attachment portion 60 in an up-down direction within a range whose upper limit is a predetermined reference level, wherein the position of the bottle attachment portion 60 in the up-down direction changes in correspondence with the load of the developer bottle 5. In the example shown in FIG. 5 to FIG. 7, the position detection portion 72 includes an interlock portion 72*a* and a position sensor 72*e*. The interlock portion 72*a* is configured to be displaced in interlock with the lifting and lowering of the bottle attachment portion 60, and the position sensor 72*e* is configured to detect the position of the interlock portion 72*a*.

The position sensor 72*e* may be a plurality of proximity sensors that are aligned along a displacement direction of the interlock portion 72*a*. Each of the proximity sensors may be, for example, a photo interrupter (PI) sensor or a reflection type sensor. In addition, the position sensor 72*e* may be an LED-type displacement sensor or a contact-type displacement sensor.

The interlock portion 72*a* is pivotably supported by a support shaft 72*b*. The interlock portion 72*a* is applied an elastic force from a third spring 72*d* so as to be held in a state where an end portion 72*c* of the interlock portion 72*a* contacts the bottle attachment portion 60. With this configuration, the interlock portion 72*a* is displaced in a predetermined direction in interlock with the lifting and lowering of the bottle attachment portion 60. In the present embodiment, the interlock portion 72*a* is displaced in the up-down direction.

The position of the interlock portion 72*a* detected by the position sensor 72*e* corresponds to the height of the bottle attachment portion 60 that changes in correspondence with the load of the developer bottle 5. That is, the position detection portion 72 detects the position of the bottle attachment portion 60 in the up-down direction, within the range whose upper limit is the reference level. The detection result of the position detection portion 72 is an index value of the weight of the waste developer 90 in the developer bottle 5.

The position detection portion 72 serves as a level detection portion that detects whether or not the position of the bottle attachment portion 60 in the up-down direction is equal to or lower than the reference level. That is, when the position detection portion 72 can detect a position of the interlock portion 72*a* that corresponds to a position of the bottle attachment portion 60 equal to or lower than the reference level, the position of the bottle attachment portion 60 is equal to or lower than the reference level.

On the other hand, when the position detection portion 72 cannot detect a position of the interlock portion 72*a* that corresponds to a position of the bottle attachment portion 60 equal to or lower than the reference level, the position of the bottle attachment portion 60 is not equal to or lower than the reference level.

The movable support portion 73 is supported in such a way as to be capable of being displaced from a support position at which to support the bottle attachment portion 60. The movable support portion 73 is displaceable between the support position and a release position at which to release the support of the bottle attachment portion 60. FIG. 5 and FIG. 6 show the movable support portion 73 that is at the support position, and FIG. 7 shows the movable support portion 73 that is at the release position.

In the example shown in FIG. 5 to FIG. 7, the support frame 66 having a support surface 66*a* that contacts the movable support portion 73, is provided below the bottle attachment portion 60. It is noted that the support frame 66 is an example of the support member.

The movable support portion 73 is pivotably supported by bearing portions 74 fixed to the lower portion of the bottle attachment portion 60. That is, the movable support portion 73 is pivotably supported by the bottle attachment portion 60 via the bearing portions 74.

The movable support portion 73 has a shaft portion 73*a*, and the shaft portion 73*a* is rotatably supported by the bearing portions 74.

The movable support portion 73 supported by the bearing portions 74 can pivot between the support position at which to support the load of the bottle attachment portion 60, with its front end 73*b* contacting the support surface 66*a* of the support frame 66, and the release position, with the front end 73*b* being separated from the support surface 66*a*.

In a case where the movable support portion 73 is positioned at the support position, the movable support portion 73 holds the bottle attachment portion 60 in a state of being higher than the reference level in position. As a result, in a case where the movable support portion 73 is at the support position, the detection result of the position detection portion 72 is that the bottle attachment portion 60 is not equal to or lower than the reference level in position.

On the other hand, when the movable support portion 73 is displaced from the support position to the release position, the support of the bottle attachment portion 60 by the movable support portion 73 is released. As a result, the movable support portion 73 is lowered to a height equal to or lower than the reference level due to the load of the movable support portion 73 itself and the load of the developer bottle 5. At this time, the first spring 71 is deformed due to the loads in a direction opposite to a direction in which the bottle attachment portion 60 is biased.

Accordingly, in the case where the movable support portion 73 is at the release position, the position detection portion 72 can detect in a reliable manner that the position of the bottle attachment portion 60 is equal to or lower than the reference level.

In addition, as shown in FIG. 7, the support surface 66*a* of the support frame 66 projects to be more on the bottle attachment portion 60 side than a base surface 66*b* of the peripherary of the support surface 66*a* located below the front end 73*b* of the movable support portion 73 at the release position.

With the configuration where the support surface 66*a* is close to the bottle attachment portion 60, the movable support portion 73 can be made short, and the interval between the movable support portion 73 at the release position and the base surface 66*b* can be made large. With this configuration, the movable range of the bottle attachment portion 60 in the up-down direction is extended, and the range within which the position detection portion 72 can detect the height of the bottle attachment portion 60 is extended.

The second spring 76 applies an elastic force to the movable support portion 73 or the movable arm portion 75 in a direction in which the movable support portion 73 moves toward the support position. One end of the second spring 76 is engaged with the bottle attachment portion 60 or a portion formed integrally with the bottle attachment portion 60, and the other end of the second spring 76 is engaged with the movable support portion 73 or the movable arm portion 75.

In the example shown in FIG. 5 to FIG. 7, the second spring 76 is a helical spring. However, the second spring 76 may be rubber or another type of spring such as a tension coil spring. It is noted that the second spring 76 is an example of the second elastic member.

The movable arm portion 75 extends from the movable support portion 73 toward the attachment space 600 of the bottle attachment portion 60. The movable support portion 73 and the movable arm portion 75 are integrally formed.

As shown in FIG. 5 and FIG. 6, in a case where the developer bottle 5 is not attached to the bottle attachment portion 60, the movable support portion 73 is kept at the support position by the elastic force of the second spring 76. At the same time, the movable arm portion 75 is kept to be projected into the attachment space 600.

An opening 60*a* is formed in a part of the bottle attachment portion 60, and the movable arm portion 75 is displaced between inside and outside of the attachment space 600 through the opening 60*a*.

On the other hand, as shown in FIG. 7, in a case where the developer bottle 5 is attached to the bottle attachment portion 60, the movable arm portion 75 contacts the developer bottle 5 and is displaced to outside the attachment space 600. Furthermore, in interlock with the displacement of the movable arm portion 75, the movable support portion 73 is displaced from the support position to the release position.

In addition, when the developer bottle 5 is removed from the bottle attachment portion 60, the movable support portion 73 returns from the release position to the support position by the elastic force of the second spring 76. At the same time, the movable arm portion 75 returns to a position at which to project into the attachment space 600.

In the bottle detection portion 7, the size of parts such as the bottle attachment portion 60, the weight of parts such as the developer bottle 5, and the characteristics of parts such as the first spring 71, are design parameters that affect the height of the bottle attachment portion 60 when the movable support portion 73 is at the release position.

The design parameters are set in such a manner that even if a variation occurs within an assumed range in the actual operation, the bottle attachment portion 60 lowers to a position equal to or lower than the reference level in a reliable manner in a case where the movable support portion 73 is at the release position. This makes it possible to avoid a situation where the height of the bottle attachment portion 60 is not detected by the position detection portion 72 when the developer bottle 5 has been attached to the bottle attachment portion 60.

In addition, although the design parameters are set as described above, when the developer bottle 5 is removed from the bottle attachment portion 60, the bottle attachment portion 60 is kept to be higher than the reference level in position by the action of the movable support portion 73 and the second spring 76.

As a result, with the adoption of the bottle detection portion 7, it becomes possible to prevent an erroneous detection from occurring on whether the developer bottle 5 is attached to the bottle attachment portion 60, due to variation in size, weight, or characteristics of parts.

In addition, a portion of the movable arm portion 75 projecting into the attachment space 600 has an inclined surface 75*a* that is inclined from the upstream side to the downstream side in the bottle insertion direction D1 and from the outer edge side to the center side of the attachment space 600.

When the developer bottle 5 inserted in the attachment space 600 contacts the inclined surface 75*a* of the movable arm portion 75, the force of the developer bottle 5 that pushes the movable arm portion 75 in the bottle insertion direction D1 acts as the force that pushes the movable arm portion 75 to outside the attachment space 600. This allows the movable arm portion 75 to be displaced smoothly in response to the attachment of the developer bottle 5.

In addition, the movable support portion 73 is pivotably supported by the bottle attachment portion 60. In this case, the positional relationship between the movable arm portion 75 and the developer bottle 5 attached to the bottle attachment portion 60 does not change even if the bottle attachment portion 60 is lifted or lowered. As a result, it is possible to prevent the elastic force of the second spring 76 from affecting the height of the bottle attachment portion 60, namely, the detection result of the position detection portion 72.

When the position detection portion 72 does not detect that the position of the bottle attachment portion 60 is equal to or lower than the reference level, the control portion 8 prohibits the image forming process. Furthermore, when the position detection portion 72 detects that the position of the bottle attachment portion 60 is equal to or lower than the reference level, the control portion 8 notifies, via the display portion 80, information regarding the amount of the waste developer 90 in the developer bottle 5.

It is noted that the waste developer collecting portion 6 includes a cover detection portion (not shown) that is configured to detect whether or not the opening/closing cover 1*a* is closed. The control portion 8 prohibits execution of the image forming process when the cover detection portion detects that the opening/closing cover 1*a* is not closed.

In addition, the waste developer collecting portion 6 may include a movable portion that is displaced in correspondence with the position of the opening/closing cover 1*a*, as a structural element that is equivalent to the movable support portion 73 of the bottle detection portion 7. The movable portion is displaced between a position at which to support the bottle attachment portion 60 to be higher than the reference level in position, and a position at which to release the support.

In the present embodiment, the waste developer collecting portion 6 includes a permeability sensor 68 that detects the permeability of the waste developer 90 in the developer bottle 5 (see FIG. 4). The permeability sensor 68 is provided in the bottle reception portion 61 of the bottle attachment portion 60.

The higher the ratio of the waste carrier 90*b* to the waste developer 90 in the developer bottle 5 is, the higher the permeability of the waste developer 90 is. In addition, the waste carrier 90*b* is higher than the waste toner 90*a* in weight per unit volume.

As a result, the higher the permeability detected by the permeability sensor 68 is, the higher the specific gravity of the waste developer 90 in the developer bottle 5 is.

In the present embodiment, the control portion 8 executes an accumulation level derivation process when the developer bottle 5 is not rotating. In the accumulation level derivation process, the accumulation level of the waste developer 90 in the developer bottle 5 is derived from the detection results of the position detection portion 72 and the permeability sensor 68. In the following description, a difference between the reference level and a height of the bottle attachment portion 60 detected by the position detection portion 72 is referred to as a "detected drop amount", and the permeability detected by the permeability sensor 68 is referred to as "detected permeability".

In the accumulation level derivation process, the control portion 8 selects a density coefficient from a plurality of predetermined candidates, based on the detected permeability, and calculates the accumulation level by multiplying the detected drop amount by the selected density coefficient.

When the accumulation level exceeds a predetermined upper limit value, the control portion 8 executes a bottle replacement promotion process. In the bottle replacement promotion process, the image forming process is prohibited, and a message promoting the replacement of the developer bottle 5 is notified via the display portion 80. It is also possible to say that the bottle replacement promotion process is a process for detecting and notifying that the developer bottle 5 is full of the waste developer 90.

It is noted that in a case where the permeability sensor 68 is not provided in the waste developer collecting portion 6, the control portion 8 executes the bottle replacement promotion process when the height of the bottle attachment portion 60 detected by the position detection portion 72 is lower than a predetermined lower-limit level.

In addition, the control portion 8 may display, as necessary on the display portion 80, a variation amount that corresponds to the accumulation level or the detected drop amount.

Application Example

In the image forming apparatus 10, the bottle detection portion 7 may be applied to the toner replenishing portions 400. In that case, the developer bottle 5 stores unused toner 9*a*. The toner 9*a* in that case is an example of the developer stored in the developer bottle 5.

It is noted that the image forming apparatus of the present disclosure may be configured by freely combining, within the scope of claims, the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus to execute an image forming process for forming an image on a sheet, the image forming apparatus comprising:

a bottle attachment member to which a developer bottle for storing developer is attached in a detachable manner;

a first elastic member that applies an upward elastic force to the bottle attachment member;

a level detection portion that detects whether or not a position of the bottle attachment member in an up-down direction is equal to or lower than a predetermined reference level;

a movable support member attached to be displaced from a support position at which the bottle attachment member is supported to be higher than the reference level, wherein the bottle attachment member is capable of being lifted and lowered when not supported by the movable support member;

a movable arm member extending from the movable support member toward an attachment space which is formed in the bottle attachment member to store the developer bottle therein;

a second elastic member that applies an elastic force to the movable support member or the movable arm member in a direction in which the movable support member moves toward the support position; and a control portion that prohibits the image forming process when the level detection portion detects that the position of the bottle attachment portion is not equal to or lower than the reference level, wherein in a case where the developer bottle is not attached to the bottle attachment member, the movable support member is kept to be at the support position by the elastic force of the second spring, and the movable arm member is kept to be projected into the attachment space, and in a case where the developer bottle is attached to the bottle attachment member, the movable arm member contacts the developer bottle and is displaced to outside the attachment space, which causes the movable support member to be displaced from the support position to a release position at which the bottle attachment member is released from being supported by the movable support member.

2. The image forming apparatus according to claim 1, further comprising:

a support member provided below the bottle attachment member and having a support surface that contacts the movable support member, wherein the movable support member is attached to the bottle attachment member in such a way as to pivot between the support position at which to support a load of the bottle attachment member, with a front end thereof contacting the support surface of the support member, and the release position, with the front end being separated from the support surface.

3. The image forming apparatus according to claim 2, wherein the support surface of the support member projects to be more on the bottle attachment member side than a base surface of a periphery of the support surface below the front end of the movable support member that is at the release position.

4. The image forming apparatus according to claim 1, wherein the bottle attachment member has, in its inside, an attachment space in which the developer bottle is inserted along a longitudinal direction thereof, and a portion of the movable arm member projecting into the attachment space has an inclined surface that is inclined from an upstream side to a downstream side in an insertion direction of the developer bottle and from an outer edge side to a center side of the attachment space.

5. The image forming apparatus according to claim 1, further comprising:

a position detection portion that detects a position of the bottle attachment member in an up-down direction within a range whose upper limit is the reference level, the position of the bottle attachment member in the up-down direction changing in correspondence with a load of the developer bottle, wherein the position detection portion serves as the level detection portion.

6. The image forming apparatus according to claim 1, wherein waste developer that is used developer is stored in the developer bottle attached to the bottle attachment member.

* * * * *